United States Patent [19]

Tagirov et al.

[11] 4,050,529

[45] Sept. 27, 1977

[54] APPARATUS FOR TREATING ROCK SURROUNDING A WELLBORE

[76] Inventors: Kurban Magomedovich Tagirov, ulitsa Lenina, 408a, kv. 25; Nikolai Rubenovich Akopian, ulitsa Sochinskaya, 64; Valery Vasilievich Konontsev, ulitsa Serova, 181; Jury Nikolaevich Lutsenko, ulitsa Lenina, 472, kv. 15, all of Stavropol, U.S.S.R.

[21] Appl. No.: 670,347

[22] Filed: Mar. 25, 1976

[51] Int. Cl.[2] ..... E21B 7/11

[52] U.S. Cl. ..... 175/422; 166/100; 166/223; 166/298; 51/439

[58] Field of Search ..... 175/422, 393, 67, 54, 175/340; 166/55, 55.1, 55.2, 55.3, 55.6, 55.7, 55.8, 106, 222, 223, 298; 51/11; 83/177; 37/62, 63; 61/53.74; 299/17; 239/589, 590.5, 591

[56] References Cited

U.S. PATENT DOCUMENTS

| | | | |
|---|---|---|---|
| 1,241,813 | 10/1917 | Bignell | 61/53.74 |
| 2,228,640 | 1/1941 | O'Neill | 166/223 |
| 2,545,195 | 3/1951 | Crake | 175/393 X |
| 2,744,361 | 5/1956 | Larson et al. | 51/11 |
| 2,807,443 | 9/1957 | Wyman | 175/393 |
| 3,070,182 | 12/1962 | Runte | 175/339 |
| 3,145,776 | 8/1964 | Pittman | 166/55 |
| 3,690,380 | 9/1972 | Grable | 166/53.1 X |
| 3,823,789 | 7/1974 | Garner | 175/340 |
| 3,887,021 | 6/1975 | Elbert | 175/67 |

FOREIGN PATENT DOCUMENTS

| | | | |
|---|---|---|---|
| 170,889 | 5/1965 | U.S.S.R. | 175/67 |

*Primary Examiner*—Ernest R. Purser
*Assistant Examiner*—Richard E. Favreau
*Attorney, Agent, or Firm*—Lackenbach, Lilling & Siegel

[57] ABSTRACT

An apparatus for treating rock surrounding a wellbore comprises a hollow elongated housing having nozzles radially mounted therein, which are projectable externally thereof. Each nozzle has a through passage communicating with the internal space of the housing to pass the flow of a fluid with an abrasive filler therethrough. The external end faces of the nozzles are shaped so as to press against the wall of the casing. Each through passage of the nozzle has a larger-diameter portion at the end thereof, facing the casing wall. The body of each nozzle has auxiliary passages, each such passage having one end thereof communicating with the larger-diameter portion of the through passage and the other end thereof communicating with the space externally of the nozzle, the auxiliary passages affording the flow of the fluid with the abrasive filler from the space defined by the said larger-diameter portion of the through passage and the adjacent casing wall, as the nozzle is closely pressed against the casing.

22 Claims, 7 Drawing Figures

APPARATUS FOR TREATING ROCK SURROUNDING A WELLBORE

The present invention relates to apparatus for treating rock surrounding a wellbore and, in particular, to hydro-sandblasting perforation of casings, with subsequent hydro-fracturing of the formation. The present invention can be used to utmost effectiveness for hydraulic fracturing of gas- and oil-bearing beds in multibed fields or thick monobed fields.

Furthermore, the present invention can be used for various kinds of bed treatment, such as brine-acid treatment, mud-acid treatment, methanol treatment, treatment with surface-active agents and other substances.

The present invention enables to produce a required number of hydraulic fracturing fissures with a specified spacing therebetween within a single run of the tubing into the well, without the use of packers.

The herein disclosed apparatus can be utilized to control the water inflow to wells, by charging various cementing substances into a water-bearing bed, and also for separating beds whenever necessary.

In developing the above-mentioned fields, e.g. oil and gas fields, it is sometimes necessary to step up the yield of the oil or gas.

This may be attained in different ways.

One of the ways involves hydraulic fracturing of the bed; another may includes treating the bed with various active agents, such as acids, salts, etc.

With the thick bearing bed more often than not it is necessary to produce several fracturing fissures in this bed.

On the other hand, with multiple bearing beds it is necessary to produce fracturing fissures and afterwards to treat them with active materials in every bed.

To perform the abovementioned operations, it is necessary to produce perforations through the casing walls, which can be effected with the aid of various devices. One of the devices is a hydroperforator having a tubular body with abrasion-resistant nozzles secured therein. A fluid with an abrasive filler is pumped into the perforator to be ejected from the nozzles and perforate the casing. The perforations produced by such a perforator are of irregular shapes and frequently slit-like. A device of this kind cannot be employed for hydraulic fracturing of the bed, since the fluid jet issuing from the nozzles would not transfer its dynamic head into the bed, on account of the cross-sectional area thereof being substantially smaller than the area of the slit made through the casing, whereby the liquid which is unobstructed returns from the bed into the casing.

There are also known in the prior art, hydroperforators featuring projectable nozzles having a slit-like opening in the end face thereof, facing the casing, through which opening the fluid issues and is reflected from the casing wall, as the nozzle is pressed against the casing. In this case, the perforations through the casing are likewise slit-like, the cross-section of a perforation being substantially greater than that of the liquid jet issuring from the nozzle, which impedes the employment of this perforator for hydraulic fracturing purposes.

Beside the abovespecified devices, there are also known gun perforators which use bullets to pierce a casing, as well as jet perforators using directed explosions to make perforations through a casing. These last-mentioned devices are employed exclusively for making perforations.

However, there is known in the prior art a device which can be used both for hydraulic perforation of a casing and for subsequent hydraulic fracturing of the bed with aid of the same device.

The housing of this last-mentioned device carries a plurality of abrasion-resistant nozzles which are projectable relative to the housing and are retained therein with springs throughout the perforating operation. With the perforating step completed, the pressure of the fluid charged into the nozzles is stepped up, whereby the nozzles are projected until they are pressed against the casing, thus closing off the path of the reflected jet back into the casing. In this case, provided that the pressure is sufficiently great, hydraulic fracturing of the bed takes place.

However, in operation of this device it is necessary to vary the pressure of the fluid, i.e. to maintain a lower pressure in the course of hydraulic perforation and upon completion of this perforation to step up the pressure, to project the nozzles and to build up the fracturing pressure.

Furthermore, to retain the nozzles in the body under the perforating pressure the apparatus has to be equipped powerful springs, which considerably complicates its structure.

It is an object of the present invention to eliminate the above-mentioned drawbacks.

It is another object of the present invention to provide a means for perforating the casing wall to form openings of a predetermined diameter, to facilitate the subsequent hydraulic fracturing.

Yet another object of the present invention is to simplify the structure of the apparatus for hydraulic perforation and hydraulic fracturing.

It is also an object of the present invention to create an apparatus capable of performing successively the perforation of a wellbore casing and hydraulic fracturing of the rock bed.

The present invention has for its aim to arrange the abrasion-resistant nozzles in the body of the apparatus so that upon piercing a perforation in the casing wall the entire kinetic energy of the jet of the abrasive-laden fluid should be spent on hydraulic fracturing of the bed.

These and other objects are attained in an apparatus for treating rock surrounding a cased wellbore, comprising a hollow elongated housing having a plurality of nozzles radially arranged therein, the nozzles being projectable externally of the housing, each nozzle having a through passage communicating with the internal space of the housing for the flow of an abrasive-laden fluid in which apparatus the end faces of the nozzles, facing externally of the housing, are shaped to be closely pressed against adjacent wall of the casing, each said through passage having adjacent to said end face an increased-diameter portion, the body of each nozzle adjacent to said increased-diameter portion of said through passage having auxiliary passages, each having one of its ends communicating with the increased-diameter portion of the through passage and its other end communicating with the space externally of the nozzle, to afford a flow of the abrasive laden fluid from the space defined by the increased-diameter portion of said through passage and the adjacent casing wall, as the nozzle is pressed closely against the casing.

With the end faces of the nozzles, facing externally of the housing, being shaped to fit closely against the casing wall, it becomes possible to pierce this wall to form therein openings or perforations of the predetermined size and to prevent unwanted damage of these openings or perforations by the liquid jet, and thus to ensure that the entire kinetic energy of the fluid jet is transmitted beyond the casing into the bearing bed, to create therein a hydraulic fracturing pressure.

With the through passage of the nozzle having the increased-diameter portion at the end thereof, facing the casing wall, a space is defined by the walls of this increased-diameter portion of the through passage and the casing wall against which the nozzle is pressed, and it is this space into which the fluid reflected by the casing wall finds its way without interfering with the perforation process.

It is expedient that the auxiliary passages for the outflow of the fluid should have their respective longitudinal axes inclined with respect to the longitudinal axis of the housing of the apparatus.

With the auxiliary passages for the outflow of the fluid having their axes inclined toward the longitudinal axis of the housing, the abrasive laden fluid is guided off the casing wall with the smallest possible hydraulic losses. It is expedient that linings made of an abrasion-resistant material should be provided in the areas of contact with the jets of the abrasive laden fluid, issuing from these passages for the outflow of the fluid.

With linings of an abrasion-resistant material being mounted in the areas of contact with the jets of the fluid issuing from the passages for the outflow of the fluid, the service life of the entire apparatus becomes substantially prolonged, due to its housing being protected against excessive erosion.

It is further expedient that bevels should be made on the ends of the nozzles, facing the casing, to prevent damaging these ends while lifting the apparatus from the wellbore.

With the bevels made on the ends of the nozzles, facing the casing, these ends would not become stuck and lodged in the casing, as the apparatus is moved in the wellbore, there being created an effort driving the nozzles into the housing, while the apparatus is reciprocating in the wellbore.

It is still further expedient that the ends of the nozzles, facing the interior of the housing, should have made therein annular grooves adapted to accommodate sealing rings therein.

With the annular grooves made in the internal ends of the nozzles and accommodating the sealing rings therein, there is no seepage of the fracturing fluid past the gaps between the nozzles and the housing, and, hence, the erosion of the housing is retarded.

It is also expedient that the side surfaces of the nozzles should have longitudinal slots adapted to receive nozzle strokelimiting studs secured in the housing.

With the longitudinal slots made in the side surfaces, it becomes possible to provide in the apparatus the studs for limiting the stroke of the nozzles and at the same time for preventing rotation of the nozzles about their longitudinal axes.

It is likewise expedient that the end face of the nozzle, adapted to be pressed against the casing wall, should be convex to closely fit the casing.

With the surface of the nozzle, adapted to be pressed against the casing, being convex to closely fit or engage the casing, seepage of the abrasive laden fluid between the casing and the convex end face of the nozzle is minimized, which reduces the rate of erosion of this end face of the nozzle and prolongs the service life of the apparatus.

The invention will be further described in connection with an embodiment thereof, with reference to the accompanying drawings; wherein.

Figure 1:
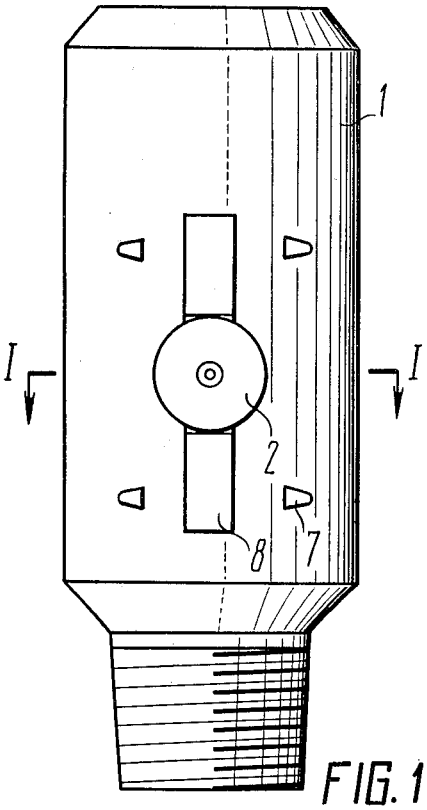
FIG. 1 shows a side view of an apparatus for treating rock surrounding a wellbore.
Figure 2:
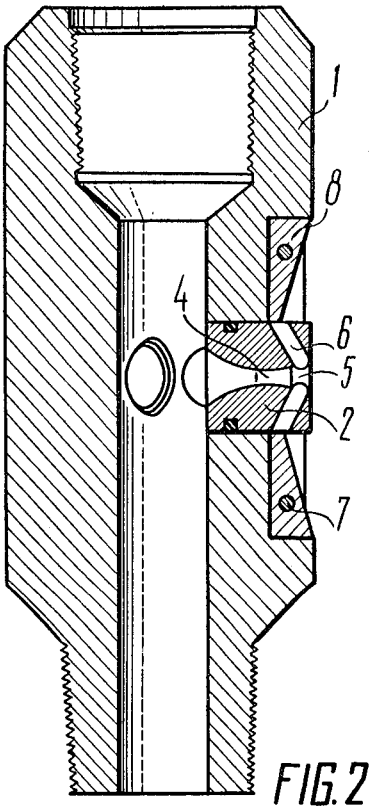
FIG. 2 is a longitudinal sectional view of an apparatus for treating rock surrounding a wellbore.
Figure 3:
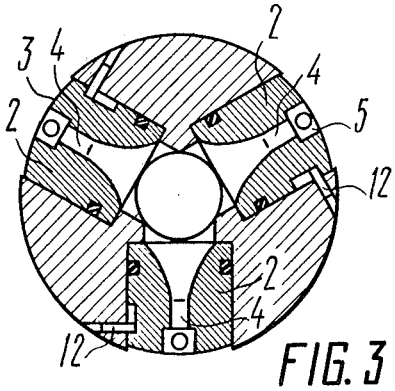
FIG. 3 is a sectional view of an apparatus for treating rock surrounding a wellbore, taken on line I—I of FIG. 1.

Referring now in particular to the appended drawings, the herein disclosed apparatus for working rock surrounding a borehole includes a housing 1 (FIGS. 1 and 2) shaped as a cylindrical tube with inlet and outlet ends. The inlet end of the housing 1 is threaded for securing the housing to a string of the tubing, through which the working fluid is pumped.

Figure 4:
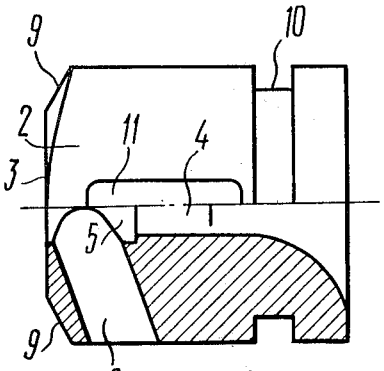
FIG. 4 is a side elevational view of a nozzle, shown partly in section.
Figure 5:
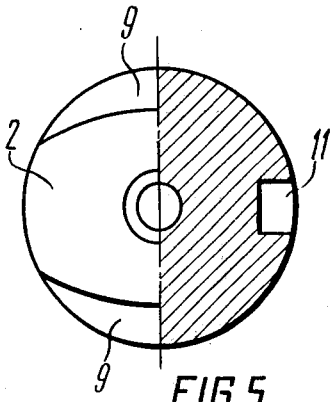
FIG. 5 is an end view of a nozzle, shown partly in section, from its external end.
Figure 6:
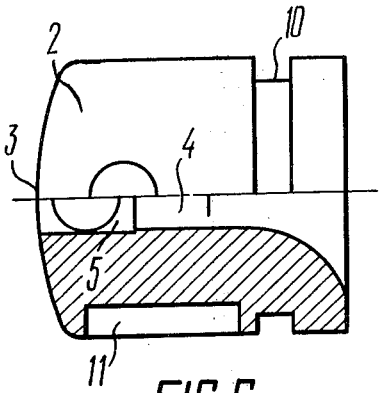
FIG. 6 is a side elevational view, shown partly in section, of the nozzle from the outlet of one of the auxiliary passages for the outflow of the abrasive laden fluid from the increased-diameter portion of the through passage.

The housing 1 has nozzles 2 radially arranged therein mounted for free reciprocation from the center of the housing 1 to the periphery thereof and vice versa. The nozzles 2 (FIGS. 2, 3, 4, 5, 6) are cylindrical members adapted to closely fit the wall of the casing of the hole, which is attained by the end face 3 (FIGS. 4, 6) of the nozzle, facing the casing and adapted to be pressed thereagainst, being cylindrically convex.

Each nozzle 2 has a through longitudinal passage 4 of a conical shape. This through passage 4 has one its end communicating with the internal space of the housing 1, while its other end faces outwardly of the housing 1, i.e. faces the casing. Each through passage 4 includes a flaring portion 5 of an increased diameter adjacent to the end facing the wall of the casing. We have found that this increased-diameter portion 5 of the through passage 4 is preferably cylindrical, which provides for an unobstructed flow of the jet of the abrasive laden fluid in the course of perforation of the casing wall and enables the formation in the casing an opening or perforation of a predetermined cross-section.

In the body of each nozzle 2 adjacent to the increased-diameter portion 5 of the through passage 4 from the side thereof, facing the casing, there are additional passages 6 each one of which having its end communicating with the increased-diameter portion 5 of the through passage 4 and its other end, acting as the outlet, communicating with the space outside the nozzle 2. The outlet ends of the additional passages 6 are situated in the side surfaces of the nozzles 2.

The geometrical axes of the additional passages 6 are inclined toward the horizontal axis of the housing 1, the additional passages 6 being intended to provide the outflow for the abrasive laden fluid, as the nozzle 2 is pressed against the casing wall, from the space defined by the increased-diameter portion 5 of the through passage 4 and the casing wall.

In the areas where the fluid, issuing from the additional bypass passages 6, contacts the housing of the apparatus, there are secured to the latter with suitable fasteners 7, e.g. keys (FIGS. 1 and 2) linings 8 made of a material resistant to abrasion wear. The linings 8 are provided to prevent the housing 1 of the apparatus from being damaged, e.g. eroded, by the jets of the fluid issuing from the bypass passages 6 communicating with the increased-diameter portion 5 of the through passages 4 of the nozzles 2.

To protect the nozzles 2 from being damaged, when the apparatus is being lifted from the wellbore after having completed an operation, and to ensure that they are positively returned into their initial positions, bevels 9 are made on the ends of the nozzles 2, facing the casing.

The end of each nozzle 2, facing the interior of the housing 1, has made in the side surface thereof an annular groove 10 adapted to accommodate a ring seal, e.g. made of rubber.

The side surfaces of the nozzles 2 have also longitudinal grooves 11 cut to receive therein studs 12 limiting the stroke outward reciprocation movement of the nozzles 2 and also preventing their rotation about their longitudinal axes with respect to the housing 1. The studs 12 are rigidly secured in the body of the housing 1.

The herein disclosed apparatus for treating rock surrounding a wellbore operates, as follows.

Figure 7:
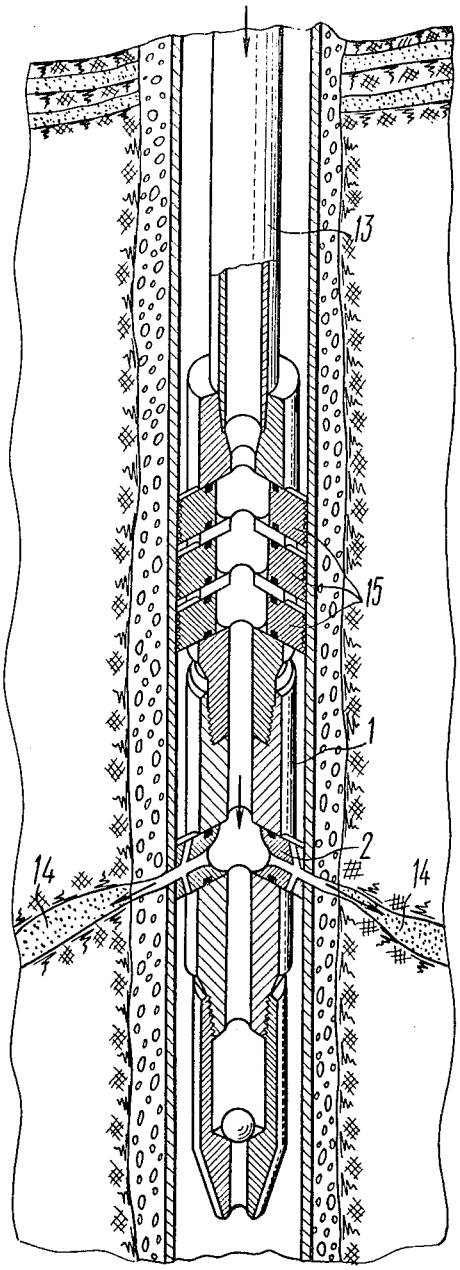
FIG. 7 is a perspective sectional view of the apparatus in a wellbore in a working position.

The apparatus in its initial position, i.e. when the nozzles 2 are retracted within the housing 1, is secured to the end of tubing 13 (FIG. 7) through which the abrasive laden fluid can be supplied to the apparatus, and the tubing is lowered into a wellbore to a required depth.

The tubing 13, to which the apparatus for treating rock surrounding the wellbore is secured, is connected to a high-pressure pumping unit and to a device for feeding- in the abrasive filler, e.g. sand (the pumping unit and the device are not shown in the appended drawings).

On the basis of the previously collected data the depth of the productive zones is calculated, and the apparatus for treating rock surrounding the wellbore is lowered into the wellbore so that the nozzles 2 shall be brought in opposition to the area selected for forming fracture 14 by hydraulic fracturing.

There should be determined the required number of such fractures to be made either in a given zone if the latter is relatively thick or in each zone if there are several beds to be fractured.

To ensure a stable position of the apparatus for treating rock surrounding the wellbore during its operation, it has to be reliably secured in the wellbore. This is attained by coupling the apparatus with the hydraulic anchor 15 of any suitable known structure, secured to the same tubing 13, which is capable of retaining the apparatus in the wellbore.

It is expedient that the apparatus for treating rock surrounding the wellbore should be lowered into the latter together also with a centering device of any suitable structure to ensure that the apparatus is centered in its operative position in the wellbore with respect to the casing, which is essential for the nozzles 2 to be projected from the housing 1 of the apparatus at equal distances.

With the apparatus for treating rock surrounding the wellbore positioned in opposition to the area where perforations are to be made, the abrasive-laden fluid is supplied by the high-pressure pumping unit into the tubing 13 to which the apparatus and the hydro-operated anchor 15 are secured. The pressure of the liquid makes the anchor operate, and the latter retains the apparatus in the borehole. The high-pressure liquid enters the housing 1 of the apparatus and projects the nozzles 2 from the housing 1.

Under the action of the pressure of the liquid the nozzles 2 become firmly pressed against the adjacent casing wall, and the fluid begins to act upon this wall. The jet of the abrasion laden fluid is reflected by the casing wall and fills the increased-diameter portion 5 of the through passage 4 of each nozzle, wherefrom it flows through the additional passages 6 in the body of the nozzle 2 into the space outside the nozzle 2. The passages 6 being inclined toward the longitudinal axis of the housing 1, the pressure loss of the abrasive laden fluid filler through the additional passages 6 is reduced.

The liquid issuing from the passages 6 impinges upon the housing 1 of the apparatus. To protect the housing 1, the latter has the abrasion-resistant linings 8 (FIG. 1) secured thereto in these areas of impingement of the abrasion laden fluid.

The abrasive action of the fluid upon the casing wall perforates the latter, i.e. openings are made therethrough. Tests have shown that the diameter of the perforation formed in the casing strictly corresponds to the increased diameter of the portion 5 of the through passage 4 of the nozzle 2, whereby it has been made possible to utilize the entire kinetic energy of the fluid issuing from the nozzle 2 for developing a dynamic head of the liquid beyond the casing, within the bed of the mineral, and thus to perform the hydraulic fracture without a loss of the pressure, since in the presently disclosed apparatus there is no return flow of the fluid from the bed into the casing.

According to one mode of operation, the pressure of the abrasion laden fluid pumped into the presently disclosed apparatus is first maintained at a value sufficient for perforating the casing.

With the perforations made through the casing wall, they can be utilized either for working and treating the rock surrounding the wellbore with various substances, or else for hydraulic fracturing of the mineral bed.

To produce the fracture 14 by hydraulic fracturing, following the perforation of the casing, the pressure of the abrasive laden fluid is then built up to a value required for hydraulic fracturing.

Alternatively, it is possible to pump the abrasion laden fluid into the apparatus from the very beginning of the operation at a pressure required for hydraulic fracturing. In this case varying the pressure becomes unnecessary, and both processes, viz. that of hydro-perforation and that of hydro-fracturing are performed at a permanent pressure not below the value required for hydraulic fracturing of the bed.

With the fractures 14 formed by the abrasive laden fluid, sand is fed into these fractures 14 through the same nozzles, to preclude self-closing of the fissures.

Should it be necessary to produce a several fissures disposed above and/or below another in a formation by hydraulic fracturing, the apparatus is not lifted from the hole, but repositioned therein, i.e. brought in opposition to another area where hydraulic fracturing is to be performed, and the above sequence of the operations is repeated for each of the fissures to be made in the bearing bed.

What is claimed is:

1. An apparatus for treating rock surrounding a cased well-bore, comprising: a hollow elongated housing; a plurality of nozzles radially arranged in said housing, and being mounted therein for free reciprocating movement from the center portion of said housing to the periphery thereof so as to project exteriorly of said housing; each said nozzle having a through passage communicating with the internal space of said housing for a flow therethrough of an abrasion laden fluid; said nozzles having their end portions facing exteriorly of said housing and being adapted to closely fit the casing wall, each said through passage of said nozzles having a larger diameter portion adjacent to said end portion; each said nozzle having additional passages one end of which communicating with said larger diameter portion of said through passage and the other end communicating with the space exteriorly of said nozzle, and said additional passages being adapted to provide an outflow of the abrasion laden fluid from the space defined by said larger diameter portion of said through passage and the adjacent casing wall, as said nozzles are pressed against said casing wall by said fluid; whereby said nozzles generally protect said casing from being washed away by said abrasive fluid, and enables perforating an opening in said casing of a diameter equal to about the diameter of said larger diameter portion and also provides where applicable for the utilization of substantially all of the kinetic energy of the flowing abrasive fluid for hydrofracturing of a formation without the need of packers.

2. An apparatus for treating rock surrounding a wellbore, as set forth in claim 1, wherein the end face of said nozzle, adapted to be pressed against the casing wall, is made convex to closely fit the casing wall.

3. An apparatus for treating rock surrounding a wellbore, as set forth in claim 1, wherein the geometric axes of said additional passages for the outflow of the fluid are inclined toward the longitudinal axis of said housing.

4. An apparatus for treating rock surrounding a wellbore, as set forth in claim 3, wherein linings made of an abrasion-resistant material are provided in the areas of contact with the jets of the abrasion laden fluid, issuing from said additional passages for the outflow of the fluid.

5. An apparatus for treating rock surrounding a wellbore, as set forth in claim 3, wherein the ends of said nozzles, facing the casing wall, are bevelled to protect said nozzles, as the apparatus is lifted from the wellbore.

6. An apparatus for treating rock surrounding a wellbore, as set forth in claim 3, wherein the internal end portions of said nozzles have cut therein annular grooved adapted to accommodate therein sealing rings.

7. An apparatus for treating rock surrounding a wellbore, as set forth in claim 3, wherein longitudinal slots are cut in the side surfaces of said nozzles, and said longitudinal slots being adapted to receive therein studs secured in said housing to limit the outward reciprocation movement of said nozzles and to prevent rotation of said nozzles about their axes.

8. An apparatus for treating rock surrounding a wellbore as set forth in claim 3, wherein the end face of said nozzle, adapted to be pressed against the casing wall, is made convex to closely fit the casing wall.

9. An apparatus for treating rock surrounding a wellbore, as set forth in claim 1, wherein linings made of an abrasion-resistant material are provided in the areas of contact with the jets of the abrasion laden fluid, issuing from said additional passages for the outflow of the fluid.

10. An apparatus for treating rock surrounding a wellbore, as set forth in claim 9, wherein the ends of said nozzles, facing the casing wall, are bevelled to protect said nozzles, as the apparatus is lifted from the borehore.

11. An apparatus for treating rock surrounding a wellbore, as set forth in claim 9, wherein the internal end portions of said nozzles are provided with annular grooves adapted to accommodate therein sealing rings.

12. An apparatus for treating rock surrounding a wellbore, as set forth in claim 9, wherein longitudinal slots are cut in the side surfaces of said nozzle, and said longitudinal slots being adapted to receive therein studs secured in said housing to limit the outward reciprocation movement of said nozzles and to prevent rotation of said nozzles about their axes.

13. An apparatus for treating rock surrounding a wellbore, as set forth in claim 9, wherein the end face of said nozzle, adapted to be pressed against the casing wall, is made convex to snugly fit the casing wall.

14. An apparatus for treating rock surrounding a wellbore, as set forth in claim 1, wherein the ends of said nozzles facing the casing wall, are bevelled to protect said nozzles from damage, as the apparatus is lifted from the wellbore.

15. An apparatus for treating rock surrounding a wellbore, as set forth in claim 14, wherein the internal end portions of said nozzles are provided with annular grooves adapted to accommodate therein sealing rings.

16. An apparatus for treating rock surrounding a wellbore, as set forth in claim 14, wherein longitudinal slots are cut in the side surfaces of said nozzles, and said longitudinal slots being adapted to receive therein studs secured in said housing to limit the outward reciprocation movement of said nozzles and to prevent rotation of said nozzles.

17. An apparatus for treating rock surrounding a wellbore, as set forth in claim 14, wherein the end face of said nozzle, adapted to be pressed against the casing wall, is made convex to closely fit the casing wall.

18. An apparatus for treating rock surrounding a wellbore, as set forth in claim 1, wherein the internal end portions of said nozzles are provided with annular grooves adapted to accommodate therein sealing rings.

19. An apparatus for treating rock surrounding a wellbore, as set forth in claim 18, wherein longitudinal slots are cut in the side surfaces of said nozzles, and said longitudinal slots being adapted to receive therein studs secured in said housing to limit the outward reciprocation movement of said nozzles and to prevent rotation of said nozzles.

20. An apparatus for treating rock surrounding a wellbore, as set forth in claim 18, wherein the end face of said nozzle, adapted to be pressed against the casing wall, is made convex to closely fit the casing wall.

21. An apparatus for treating rock surrounding a wellbore, as set forth in claim 1, wherein longitudinal slots are cut in the side surfaces of said nozzles, and said longitudinal slots being being adapted to receive therein studs secured in said housing to limit the outward reciprocating movement of said nozzles and to prevent rotation of said nozzles about their axes.

22. An apparatus for treating rock surrounding a wellbore, as set forth in claim 21, wherein the end face of said nozzle, adapted to press closely against the casing wall, is made convex to closely fit the casing wall.

* * * * *